US009695637B2

(12) United States Patent
Valliyappan et al.

(10) Patent No.: US 9,695,637 B2
(45) Date of Patent: Jul. 4, 2017

(54) DOWNHOLE TURBINE MOTOR AND RELATED ASSEMBLIES

(71) Applicant: SMITH INTERNATIONAL, INC., Houston, TX (US)

(72) Inventors: Somasundaram Valliyappan, Spring, TX (US); Jeffrey N. Dodge, Kingwood, TX (US)

(73) Assignee: SMITH INTERNATIONAL, INC., Houston, TX (US)

( * ) Notice: Subject to any disclaimer, the term of this patent is extended or adjusted under 35 U.S.C. 154(b) by 569 days.

(21) Appl. No.: 14/198,890

(22) Filed: Mar. 6, 2014

(65) Prior Publication Data

US 2014/0262524 A1 Sep. 18, 2014

Related U.S. Application Data

(60) Provisional application No. 61/787,791, filed on Mar. 15, 2013.

(51) Int. Cl.
*E21B 4/02* (2006.01)
*F03B 13/02* (2006.01)

(52) U.S. Cl.
CPC ..... *E21B 4/02* (2013.01); *F03B 13/02* (2013.01)

(58) Field of Classification Search
CPC ..... E21B 4/02; E21B 4/00; F03B 13/02
See application file for complete search history.

(56) References Cited

U.S. PATENT DOCUMENTS 3,583,502 A * 6/1971 Henderson ..... E21B 21/12 175/107
4,676,716 A 6/1987 Brudny-Chelyadinov et al.
5,105,113 A 4/1992 Ishikura et al.
6,133,668 A 10/2000 Huang et al.
6,611,078 B1 8/2003 Durham et al.
6,720,697 B2 4/2004 Harada et al.
8,063,529 B2 11/2011 Wong et al.
8,106,554 B2 1/2012 Lee et al.
2004/0200642 A1 10/2004 Downie et al.
(Continued)

FOREIGN PATENT DOCUMENTS

EP 0671563 A1 9/1995
FR 2907982 B1 5/2008

OTHER PUBLICATIONS

International Search Report and Written Opinion issued in International Patent Aplication No. PCT/US2014/022046, mailed Aug. 26, 2014, 13 pages.

*Primary Examiner* — Wei Wang

(57) ABSTRACT

A turbine drive may include a rotor that includes multiple turbine blades arranged in one or more turbine stages, as well as a stator cooperating with the rotor to direct fluid against the turbine blades and convert hydraulic, kinetic energy into rotational energy. The rotor may be fixed to the shaft to rotate synchronously therewith. The stator may be formed of multiple components that can be coupled together to define the stator and encompass the turbine blades of the turbine stages of the rotor. Two stator halves may each include vanes for positioning above and below a corresponding turbine stage, to direct fluid against the turbine blades. The stator may also be connected to a housing that encompasses the stator. Longitudinal slots and tabs on the stator and housing may hold the stator stationary relative to the housing.

18 Claims, 9 Drawing Sheets

(56) References Cited

U.S. PATENT DOCUMENTS

| | | | | |
|---|---|---|---|---|
| 2005/0069406 | A1* | 3/2005 | Turnquist ..... | F01D 11/20 415/1 |
| 2007/0143983 | A1 | 6/2007 | Yamaguchi et al. | |
| 2010/0013337 | A1 | 1/2010 | Qin et al. | |
| 2010/0307833 | A1 | 12/2010 | Kollé et al. | |
| 2011/0084564 | A1 | 4/2011 | Huang | |
| 2013/0011211 | A1 | 1/2013 | Heshmat et al. | |

* cited by examiner

DOWNHOLE TURBINE MOTOR AND RELATED ASSEMBLIES

CROSS-REFERENCE TO RELATED APPLICATIONS

This application claims the benefit of, and priority to, U.S. Patent Application Ser. No. 61/787,791 filed on Mar. 15, 2013 and entitled "DOWNHOLE TURBINE MOTOR AND RELATED ASSEMBLIES," which application is hereby incorporated by this reference in its entirety.

BACKGROUND

A well may be drilled into the ground for a variety of extraction or exploratory purposes. By way of example, a wellbore may be formed to allow liquids such as water or petroleum, or gases such as natural gas, to be extracted therefrom. In yet other cases, a wellbore may be formed to obtain information about the physical properties of soil and rock in a particular area, or to explore for mineral or ore deposits.

Various drilling systems and mechanisms may be used to drill or otherwise create wellbores, which wellbores themselves may vary from a few feet to a few miles in depth. Particularly for long wellbores, mechanical drilling systems may be used to drill the wellbore. An example rotary drilling system may include a drill rig that uses a rotary table or top drive to rotate a drill string within the wellbore. The drill string can include a bottomhole assembly ("BHA") that includes a drill bit. The BHA may in turn be coupled to a string of drill pipe that is rotated to provide torque to the drill bit. The drill pipe may also be hollow or have conduits therein to pass drilling fluid to and from the drill bit to cool the drill bit, convey cuttings to the surface, or for other purposes.

Whereas rotary drilling systems may rotate a drill string to provide torque to a drill bit, other drilling systems may operate in other manners. In a coiled tubing system, for instance, continuous, coiled tubing may be supplied from a spool that is located at the surface. An injector can grip the tubing and insert and withdraw the tubing from the wellbore. A BHA may be coupled to an end of the coiled tubing and inserted into the wellbore. The BHA may in turn include a motor that is used to rotate a drill bit. A motor may be driven by using drilling fluids that are pumped from surface equipment through coiled tubing or a drill string. The drilling fluid may flow downwardly toward the motor, and the motor may convert the axial flow of the drilling mud into a rotational force used to drive the drill bit located below the motor.

SUMMARY OF THE DISCLOSURE

In one aspect, a turbine drive is disclosed for converting hydraulic flow into rotational power, and includes a rotor with turbine blades, and a stator with circumferential vanes. The stator may be formed from separate components that each have portions of the circumferential vanes. Optionally, the rotor includes multiple turbine stages axially offset along a shaft. The stator, and each stator component, may include vanes to direct fluid for a single turbine stage, or for multiple turbine stages. According to at least some aspects, the turbine drive may be combined with other turbine drives into a motor assembly that couples to a drive shaft to power a rotary tool of a bottomhole assembly.

In another aspect, a turbine drive for converting hydraulic flow into rotational power includes a shaft, a rotor, and a stator. The rotor may have at least one set or stage of turbine blades coupled to the shaft. The stator may define at least one set of vanes cooperating with the turbine blades, and may include separable first and second components each having a portion of some of the vanes.

According to still another aspect of the present disclosure, a downhole tool is described and includes a body, a motor assembly, a drive shaft, and a rotary tool. The motor assembly may be coupled to the body and may include a plurality of turbine drives. Each turbine drive may include a rotor coupled to a rotatable shaft and configured to rotate synchronously with the rotatable shaft even without compression. The drive shaft may be coupled to the rotatable shaft of the motor assembly, and the rotary tool may be coupled to the drive shaft.

A method is also disclosed in some embodiments for rotating a downhole tool. The downhole tool may be inserted into the wellbore, and may include a bit and a motor for rotating the bit. The motor may include one or more turbine drives each of which includes a shaft, rotor, and stator. The rotor may have a plurality of axially offset sets or stages of turbine blades coupled to the shaft. The stator may include at least one set or stage of vanes for directing fluid against the turbine blades. The downhole tool may be powered while within the wellbore by, for instance, flowing drilling fluid through a drill string to the downhole tool. The drilling fluid may strike the turbine blades to rotate the shaft and rotor independent of the stator. The shaft may also be coupled to the bit to cause rotation of the bit.

This summary is provided to introduce some features and concepts that are further developed in the detailed description. Other features and aspects of the present disclosure will become apparent to those persons having ordinary skill in the art through consideration of the ensuing description, the accompanying drawings, and the appended claims. This summary is therefore not intended to identify key or essential features of the claimed subject matter, nor is it intended to be used as an aid in limiting the scope of the claims.

BRIEF DESCRIPTION OF DRAWINGS

In order to describe various features and concepts of the present disclosure, a more particular description of certain subject matter will be rendered by reference to specific embodiments which are illustrated in the appended drawings. Understanding that these drawings depict just some example embodiments and are not to be considered to be limiting in scope, nor drawn to scale for each embodiment contemplated hereby, various embodiments will be described and explained with additional specificity and detail through the use of the accompanying drawings in which.

DETAILED DESCRIPTION

In accordance with some aspects of the present disclosure, embodiments herein relate to rotary downhole tools. More particularly embodiments disclosed herein may relate to downhole tools that include a bottomhole assembly ("BHA") with a motor for rotating a drill bit, mill, or other rotary tool. An example BHA may include a motor that uses a set of one or more turbine components to transform axial fluid flow into a rotational motion that drives the drill bit, mill, or other rotary component.

Figure 1:
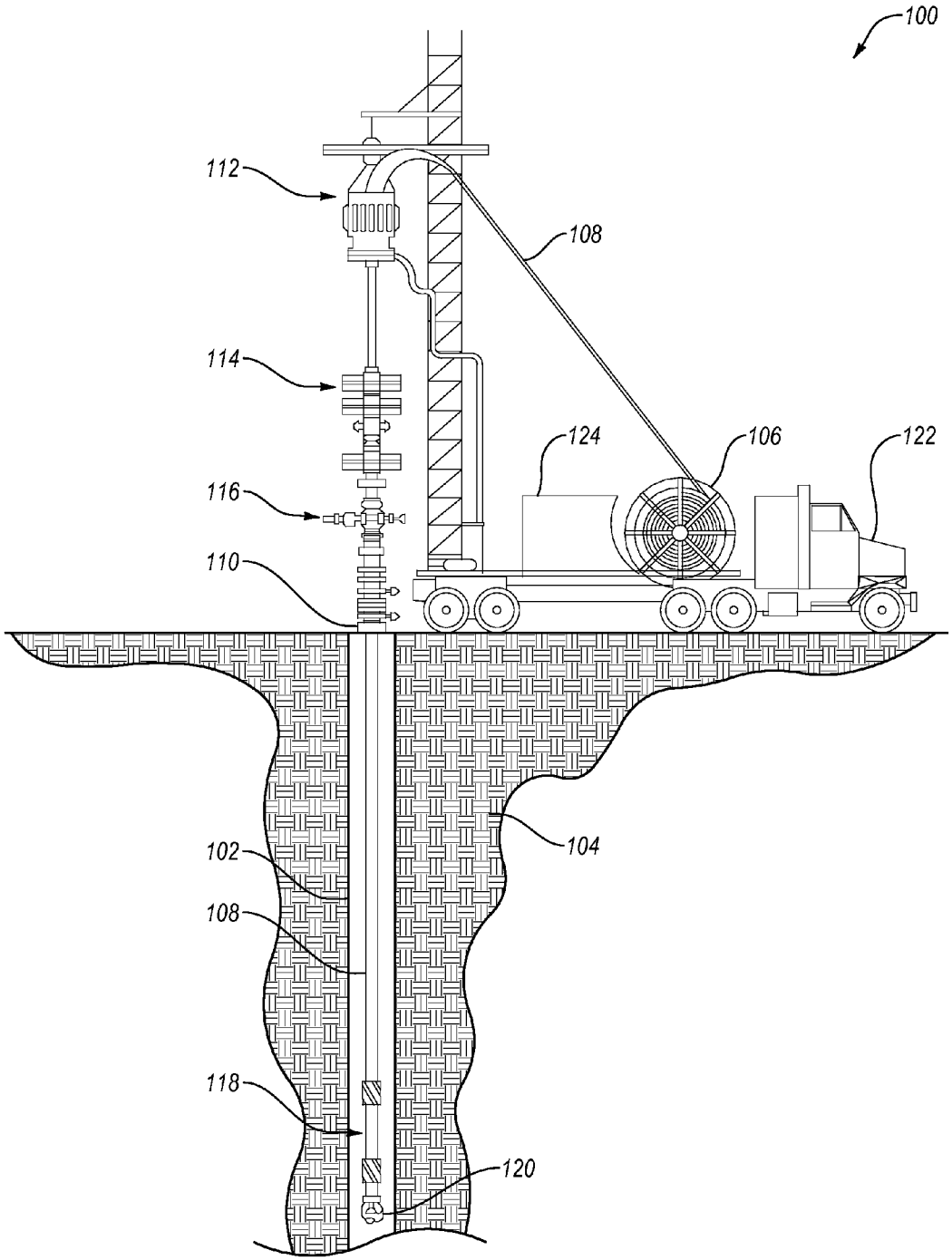
FIG. 1 schematically illustrates coiled tubing equipment for use with a downhole tool.

Referring now to FIG. 1, a rigging system 100 that may be used for providing coiled tubing services or operations is schematically illustrated. In this particular embodiment, example coiled tubing operations may be provided for use with a wellbore 102 drilled or otherwise formed within an earthen formation 104.

The rigging system 100 may be used to provide coiled tubing services or operations using a spool 106 that has coiled tubing 108 spooled thereon. The spool 106 may rotate about its axis and, when rotated in one direction (e.g., clockwise or counter-clockwise), the coiled tubing 108 may unspool from the spool 106. As an increased length of the coiled tubing 108 is unspooled, the coiled tubing 108 may be inserted into the wellbore 102 through a wellhead 110. Various components may be used to inject or otherwise facilitate insertion of the coiled tubing 108 into the wellbore 102. In this particular embodiment, the unspooled coiled tubing 108 may pass through an injector head 112 which injects the coiled tubing 108 into the wellbore 102 through control hardware. Example types of control hardware may include blowout preventers 114, control valves 116, other components, or some combination of the foregoing.

As further shown in FIG. 1, the coiled tubing 108 may be inserted into the wellhead 110 and passed downwardly into the wellbore 102. At a downhole end of the coiled tubing 108, the coiled tubing 108 may be coupled to a BHA 118. In the illustrated embodiment, the BHA 118 includes a drill bit 120, although a BHA may include other or additional components. Examples of other components that may be included with, or instead of, the drill bit 120 include: mills, motors, measurement tools, sensors, logging tools, cleaning nozzles, packers, reentry components, retrieval tools, whipstocks, perforation or fracking equipment, plugs, other downhole components, or some combination of the foregoing.

The rigging system 100 may be fixed or mobile in nature. In the illustrated embodiment, for instance, the rigging system 100 includes a truck 122. The truck 122 may be selectively moved to the location of the wellhead 110 and used to provide and convey the coiled tubing 108 that is injected into the wellbore 102. The truck 122 may have the spool 106 and/or other components coupled thereto. For instance, a tank 124 is optionally located on the truck 122. The tank 124 may have drilling fluid therein. The drilling fluid may be conveyed from the tank 124 to an open end of the coiled tubing 108 (e.g., an end at a center of the spool 106). The drilling fluid may then pass through the coiled tubing 108 and to the BHA 118, including the drill bit 120. Optionally, the truck 122 may include other or additional equipment. For instance, surface control equipment (not shown) may be provided and used to control the injection of the coiled tubing 108 by the injector 114 through the wellhead 110. The control equipment may also be used to control the operation of tools on the BHA 118. Additional equipment, such as monitoring equipment (not shown) may also be provided on the truck 122, which equipment may be separate from, or integrated with, control equipment. Monitoring equipment may be used to monitor the status of, or data provided by, the BHA 118.

The truck 122 may be mobile so as to move from well-to-well. In other embodiments, a drilling rig may include other mobile units other than a truck. For instance, in offshore drilling operations, a marine vehicle such as a barge may be used to provide mobile coiled tubing operations. In still other embodiments, the drilling rig 100 may include a more permanent installation at the wellhead 110 to provide at least some of the same services as the truck 122. Further, while the drilling rig 100 is shown as including various components together on the same structure (e.g., the spool 106 and the tank 124 on the truck 122), different components may be otherwise located or positioned. For instance, the spool 106 could be on the truck 122 while the tank 124 may be located a separate mobile or fixed structure.

Figure 2:
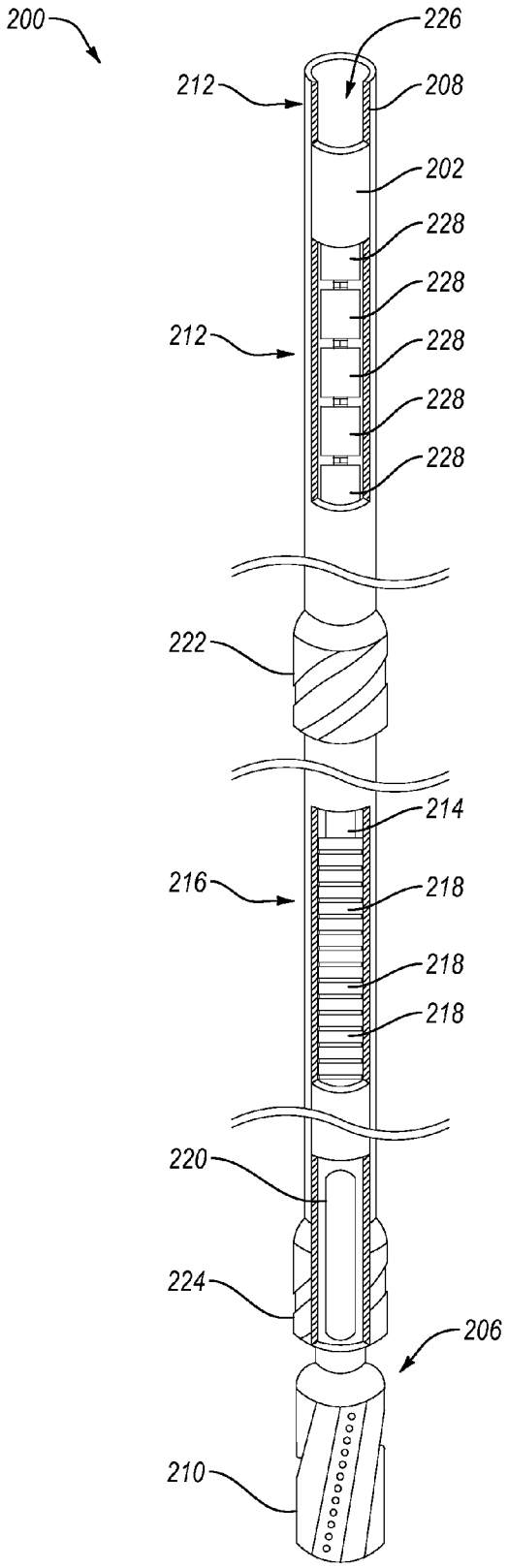
FIG. 2 illustrates a partial cross-sectional view of a downhole tool in accordance with some embodiments of the present disclosure.

Turning now to FIG. 2, an example BHA 200 is shown in additional detail. The BHA 200 of FIG. 2 is illustrative of a BHA that may be used in connection with the drilling rig 100 of FIG. 1; however, the BHA 200 may be used in connection with a variety of other rigs and systems. Thus, FIG. 1 merely provides an example environment in which the BHA 200 may be used, but is not intended to limit the systems or applications of the BHA 200, and vice versa.

The BHA 200 may include a body 202 having an upper end portion 204 and a lower end portion 206. In this particular embodiment, the body 202 may include an upper connection 208 for coupling to a drill string (not shown). An example drill string that is coupled to the upper connection 208 may include coiled tubing (see FIG. 1); however, the drillstring may be formed of segmented drill pipe, or may have any other suitable configuration. At the lower end portion 206 of the body 202, the BHA 200 may include a bit 210. The bit 210 may include a drill bit, a mill, or other components used downhole for cutting into a formation, casing, downhole tool, plug, or other element. The BHA 200 may further include other components useful for a variety of downhole operations. By way of illustration and not limitation, drill collars, mud motors, reamers, underreamers, jars and agitator tools, rotary steering tools, sensors, logging tools, measurement tools, communication tools, whipstocks, other components, or some combination of the foregoing, may be included as part of the BHA 200, or coupled thereto.

In the particular embodiment illustrated in FIG. 2, the BHA 200 may be configured to rotate the bit 210 for drilling a wellbore. Various additional components may be included in the BHA 200 to facilitate such operation. For instance, a motor assembly 212 may be used to rotate a drive shaft 214. The drive shaft 214, in turn, may in turn be coupled to the bit 210 and provide a rotational force thereto. Accordingly, the drive shaft 214 may extend upwardly from the bit 210 through a full length of the body 202, or through a portion thereof. In some embodiments, the drive shaft 214 may have multiple components. For instance, as discussed in greater detail herein, a motor assembly (e.g., motor assembly 214) may include multiple components (e.g., turbine drives 228). Each component may include its own shaft which, when combined together, define a segmented portion of the drive shaft 214.

Optionally, one or more bearing assemblies 216 may be coupled to the drive shaft 214, the motor assembly 214, or the turbine drives 228. An illustrative bearing assembly 216 may include one or more thrust bearings 218 coupled to the drive shaft 214 to support axial loading on the drive shaft 214. One or more radial bearings 220 may also be included between the drive shaft 214 and the body 208 to reduce friction and facilitate rotation of the drive shaft 214 within the body 202. In some embodiments, the body 202 may be coupled to an upper stabilizer 222 and/or a lower stabilizer 224 which may facilitate maintaining the BHA 200 in a centered position within a wellbore.

In accordance with some embodiments of the present disclosure, the BHA 200 may be configured to rotate the bit 210 using flowing drilling fluid or mud (not shown). The body 202 may define one or more channels 226 extending axially through at least a portion of the body 202. Drilling fluid may pass through the openings 226 at a desired flow rate and pressure, and into the motor assembly 212. The motor assembly 212 may include one or more turbine drives 228 that can translate the axial motion of the drilling fluid into a rotational motion of the drive shaft 214. In particular, a turbine drive 228 may include one or more turbine stages. Example turbine drives 228 may include one or more turbine stages, with each stage having a rotor and a stator. The stator may be relatively stationary to the body 202 and may include various vanes that receive drilling fluid and redirect the flow against blades of the rotor. When the fluid flows against the turbine blades of the rotor, the rotor may rotate. Each rotor may be coupled to a rotatable shaft. Such shafts can be coupled to the drive shaft 214, or form a portion thereof, to ultimately drive and rotate the bit 210.

Figure 3:
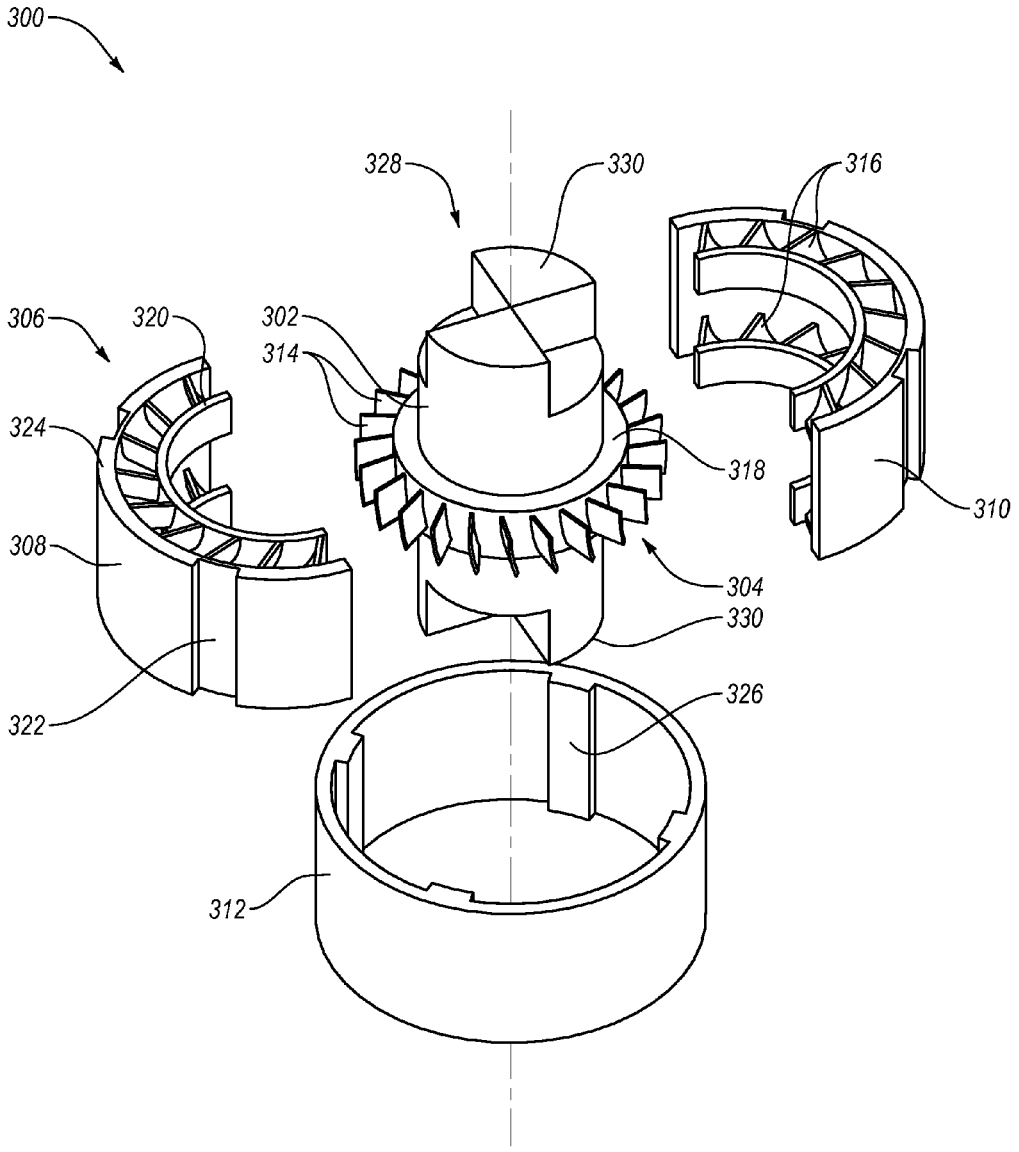
FIG. 3 illustrates an exploded, perspective view of a turbine drive assembly in accordance with some embodiments of the present disclosure.
Figure 4:
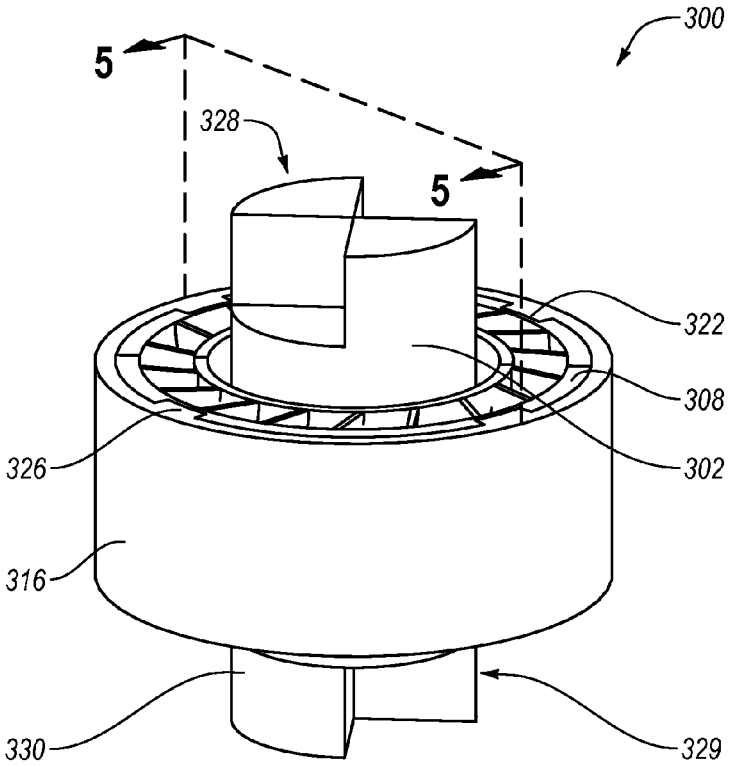
FIG. 4 illustrates a perspective view of the turbine drive assembly of FIG. 3 following assembly.
Figure 5:
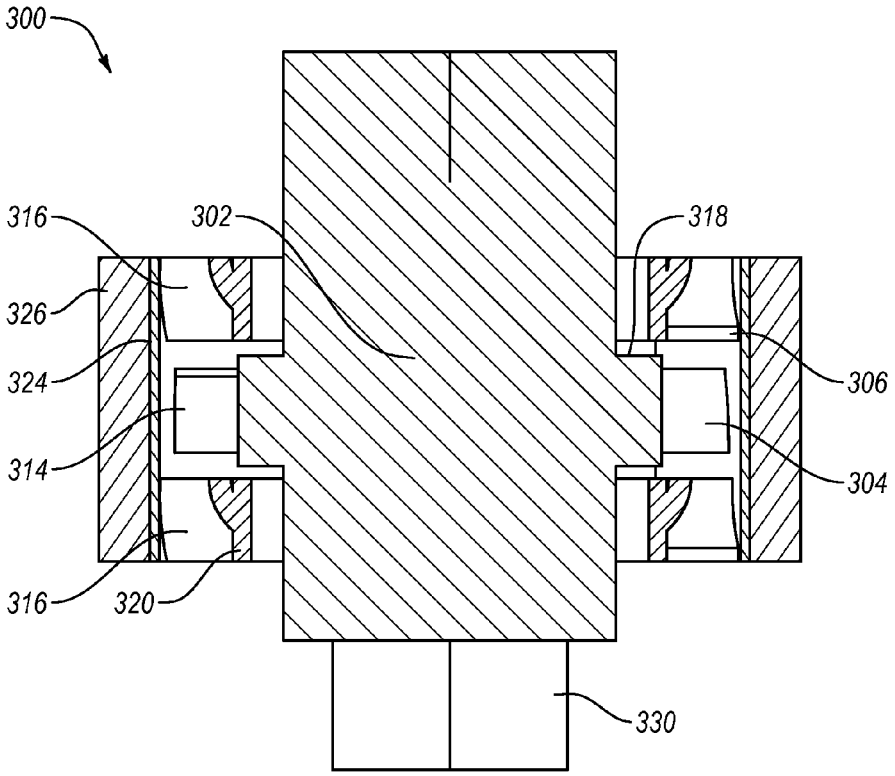
FIG. 5 illustrates a cross-sectional side view of the turbine drive assembly of FIG. 4.

FIGS. 3-5 provide various views of an example turbine drive 300 that may be used in connection with the BHA 118 of FIG. 1, the BHA 200 of FIG. 2, or in connection with a variety of other systems or components. The embodiment illustrated in FIG. 3 provides an exploded assembly view of a turbine drive 300 that includes a shaft 302 having a rotor 304 coupled thereto. The rotor 304 may be configured to operate in connection with a stator 306 which may, in some example embodiments, be formed from two stator halves 308, 310. The turbine drive 300 may further include a housing 312 for enclosing at least a portion of the rotor 304 and/or the stator 306.

The components of the turbine drive 300 as shown in FIG. 3 may be assembled as shown in FIGS. 4 and 5. In particular, FIG. 4 shows a perspective view of an assembled turbine drive 300 while FIG. 5 illustrates a cross-sectional view of the assembled turbine drive 300 to show the operation of interior components of the turbine drive 300. As shown in the illustrated embodiments, the rotor 304 may include multiple turbine blades 314 circumferentially spaced around an outer surface of the shaft 302. The turbine blades 314 may be configured to receive axially flowing fluid (e.g., drilling fluid) and transform the axial motion into a rotational motion by causing the rotor 304 and the shaft 302 to rotate. In particular, as can be seen in FIG. 3, the turbine blades 314 may be angled and/or may have a curved, arcuate, or other shape. As fluid flows towards the turbine blades 314, the fluid can strike transversely across the turbine blades 314. The kinetic energy of the fluid may then be converted to rotational energy as the turbine blades 314 cause the rotor 304 to rotate.

In accordance with some embodiments of the present disclosure, the turbine blades 314 may be integral with, or otherwise permanently coupled to, the shaft 302. As a result, when the turbine blades 314 rotate, the shaft 302 may also rotate. As discussed herein, the shaft 302 is optionally coupled to additional turbine drives 300 which may add additional power to a BHA (e.g., BHA 200 of FIG. 2) or other downhole tool. Whether a single turbine drive 300 or multiple turbine drives 300 are used, the rotational power may be used to power and rotate a drive shaft, bit, other component, or some combination of the foregoing.

While the turbine blades 314 may be angled and/or arcuate to facilitate transforming axial fluid flow into rotational motion of the rotor 304 and shaft 302, the turbine blades 314 may also have other structures, configurations, or the like. Any number of turbine blades 314 may also be used. For instance, a rotor 304 (or single rotor stage) may include between 6 and 60 turbine blades 314 in some embodiments. More particularly, the number of turbine blades 314 may range from a low of 6, 10, 15, 20 or 25 to a high of 30, 35, 40, 50, 60 or more. In other embodiments, fewer than 6 or more than 60 turbine blades 314 may be included in a rotor 304.

In some embodiments of the present disclosure, the shape, position, number, or other structure of the turbine blades 314 may be calculated to operate in connection with the stator 306. For instance, the stator 306 may include multiple vanes 316 through which drilling fluid may pass prior to reaching and striking the turbine blades 314 of the rotor 304. In some embodiments, fluid flowing into the turbine drive 300 may flow in an axial direction, and optionally be generally laminar. The vanes 316 of the stator 306 may redirect the fluid from a generally axial and/or laminar flow. In particular, the fluid may be redirected to flow at an angle relative to the longitudinal axis of the bore 226 to, for instance, flow more directly against (e.g., more perpendicular to) the turbine blades 314, thereby increasing efficiency of the turbine drive 312.

The turbine drive 300 of FIGS. 3-5 further illustrates an example embodiment in which the stator 306 may include two sets of circumferential vanes 316. The sets of vanes 316 may be positioned to be on opposing axial sides of the rotor 304. Thus, a first, upper set of vanes 316 may receive the fluid and redirect the fluid to strike more directly against the turbine blades 312. After engaging and rotating the turbine blades 312, the fluid may then flow against the second, lower or downhole set of vanes 316 which again redirect the fluid. Optionally, the fluid may be redirected in an about axial direction, or in a direction transverse to turbine blades of a subsequent rotor. In some embodiments, the upper or lower sets of vanes 316 may be removed entirely. Thus, while the upper and lower sets of vanes 316 may have generally the same shape or configuration (e.g., inclined, curved, etc.), in other embodiments, the upper and lower vanes 316 may be different. The number of vanes 316 each set of vanes 316 also may or may not correspond to the number of turbine blades 314. In some embodiments, for instance, the number of vanes 316 may be equal to the number of turbine blades 314. In other embodiments, more or fewer vanes 316 may be included. As an example, there may be between 1 and 5 more or fewer vanes 316 than turbine blades 314.

Whereas the rotor 304 and shaft 302 may be caused to rotate by fluid passing through the turbine drive 300, the stator 306 may be configured to remain relatively stationary (e.g., stationary relative to body 202 of FIG. 2) in some embodiments. As can be seen in FIG. 5, for instance, the rotor 304 may be positioned between the upper and lower sets of vanes 316. The height and other dimensions of the turbine blades 314 may be about the same as, or less than, the distance between the sets of vanes 316. Consequently, rotation of the rotor 304 may be accomplished with little or no engagement between the turbine blades 314 and the stator 306. As shown in FIGS. 3 and 5, the rotor 304 may optionally include a collar 318 extending circumferentially around the shaft 302. The collar 318 may be aligned with the turbine blades 314 and positioned within the stator 306 between the upper and lower sets of vanes 316. The collar 318 may be taller than the turbine blades 314 in some embodiments to create space between the turbine blades 314 and the vanes 316. In some embodiments, the collar 318 may have a height less than a distance between the upper and lower sets of vanes 316. Consequently, the rotor 304 may be able to float within the stator 306 and move axially upwardly or downwardly within the interior of the stator 306, although fluid within the turbine drive 300 may at times restrict direct contact between the collar 318 and the stator 306. In other embodiments, the collar 318 may have a height about equal to the distance between the upper and lower sets of vanes 316. In such an embodiment, the collar 318 may optionally be a bearing.

The collar 318 may also be used to maintain the rotor 304 within the stator 306. For instance, as may be seen with reference to FIG. 5, if the rotor 304 is moved upwardly or downwardly relative to the stator 306, the collar 318 may engage the interior rings 320 or rims coupled to the vanes 316, thereby resisting or potentially preventing further axial translation. The axial translation of the rotor 304 may therefore be limited to the space within the stator 306 and between the interior rings 320.

In embodiments in which the collar 318 is included, the collar 318 may be formed integrally with the shaft 302 and/or the turbine blades 314 of the rotor 304, or may be coupled to one or both of the shaft 302 or the turbine blades 314. In some embodiments, the collar 318, rotor 304, and shaft 302 may be integrally formed and may rotate together as fluid flows against the turbine blades 314 as discussed herein. In other embodiments, one or more components may be separately formed and optionally coupled to the other components. The collar 318 may, for instance, be a bearing (e.g., a trust bearing) that is coupled to the shaft 302 and/or the rotor 304, and optionally permanently coupled thereto. Integrally forming the components, or separate formation and subsequent connections, may allow the shaft 302 and rotor 304 to rotate at the same time. In other embodiments, other mechanisms may also be used. For instance, a compression shroud (not shown) may be used to compress the rotor 304 against the shaft 302, although compression may be limited or may be entirely absent in some embodiments of the present disclosure.

As seen in FIG. 3, the stator 306 may be formed of multiple stator components in some embodiments of the present disclosure. In this particular embodiment, the stator 306 is generally symmetric and formed from two distinct stator halves 308, 310. Each stator half 308, 310 may be identical, a mirror-image of the other, or otherwise similar. In some embodiments, each stator half 308, 310 may have a shape that is generally semi-circular when viewed from above, and may include some of the vanes 316 that are positionable both above and below the turbine blades 314 of the rotor 304. In other embodiments, components of the stator 306 may have other structures or configurations. For instance, more than two separable components (e.g., three, four or more) may be combined together to form the stator 306. In another embodiment, the stator 306 may be formed of two halves, but the halves may be axially offset relative to each other, as opposed to radially offset as shown in FIG. 3. In such an alternative embodiment, the halves of a stator 306 may be generally circular in shape, with each half including the vanes 316 that may be positioned on either the upper or lower side of the turbine blades 314.

To maintain the stator 306 rotationally stationary relative to the housing 312, any number of mechanisms may be used. Compression may be used by, as discussed above, using a compression shroud (not shown) to compress the housing 312 against the stator 306 or vice versa. In other embodiments, however, compression may not be used to restrict rotation of the stator 306 relative to the housing 312. FIGS. 3-5, for instance, illustrate an example embodiment in which the halves 308, 310 of the stator 306 include a set of slots 322 on an outer ring 324 of the stator 306. In particular, the illustrated slots 322 are shown as longitudinal grooves in the exterior surface of the outer ring 324.

The outer diameter of the outer ring 324 may be about equal to, or slightly less than, the internal diameter of the housing 312. Consequently, the stator 306 may be slid or otherwise positioned within the interior of the housing 312. In one embodiment, the housing 312 may in turn include a set of tabs 326 on the interior surface thereof. The number and position of the tabs 326 may generally correspond to the location of the slots 322 of the stator 306. The size, shape, number and dimensions of the slots 322 and tabs 326 may be configured or otherwise designed to couple the stator 306 to the housing 312 in a way that restricts, if not prevents, rotation of the stator 306 relative to the housing 312. Thus, if the stator 306 were to attempt to rotate, engagement between the housing 312 and the stator 306 as a result of the tabs 326 within the slots 322 may be used to resist and potentially prevent such rotation of the stator 306.

While four tabs 326 and four slots 322 are illustrated in the embodiment of FIGS. 3-5, such an embodiment is intended to be illustrative. Indeed, any number of tabs 326 and slots 322 may be used. For instance, between 1 and 20 slots 322 may be provided on the stator 306, with corresponding numbers of tabs 326 on the housing 312. In other embodiments, however, more slots 322 and/or tabs 326 may be used, or the number of slots 322 may be different (e.g. greater) than the number of tabs 326. Further, while the slots 322 and tabs 326 are shown as generally having a rectangular cross-sectional shape, the structures of the slots 322 and tabs 326 may be varied. In other embodiments, for instance, the cross-sectional shapes may be generally triangular, trapezoidal, elliptical, circular, square, rhomboidal, dovetailed, or have any other suitable construction. Further still, while the slots 322 are shown on the stator 306 and the tabs 326 on the housing 312, their corresponding positions may be reversed.

The slots 322 and tabs 326 are shown purely to illustrate that mechanical connectors or couplings may be used to generally couple the housing 312 to the stator 306 so that there is minimal or no rotation of either component relative to each other. The slots 322 and tabs 326 may be replaced or supplemented by other structures to provide a similar effect. For instance, the slots 322 and/or tabs 326 may not extend along the full lengths of the corresponding stator 306 or housing 312. Further, other structures such as threads, pins, clasps, or other structures, or some combination thereof, may be used.

As discussed herein, one aspect of some embodiments of the present disclosure is the use of modular components within a modular power assembly, or motor assembly. A modular turbine drive 300, for instance, may allow multiple turbine drives 300 to be coupled together. An operator may therefore vary the power based on the particular application for which the motor assembly or a BHA is used. One aspect of the embodiment of the turbine drive 300 of FIGS. 3-5 is that it may be modular and used in combination with any number of other turbine drives 300. Thus, the turbine drive 300 may be used in a system using a single turbine stage just as easily as in a system using a few hundred turbine stages.

To facilitate use of the turbine drive 300 in a modular manner, the shaft 302 may include connectors or other features for facilitating a coupling with a shaft 302 of another turbine drive 300. In this particular embodiment, and as can be seen in FIGS. 3 and 4, the ends 328 of the shaft 302 may include a connector 330 which is illustrated as including alternating protrusions and depressions that allow for a drop-in connection. More particularly, the illustrated embodiment is shown as including alternating wedge-shaped protrusions and depressions. In general, the shape and height of the protrusions may be about the same as the shape and depth of the depressions. Accordingly, a first end 328 of the shaft 302 of one turbine drive 300 may be coupled to a second end 329 of another turbine drive 300 by inserting the protrusions into the depressions of the corresponding connectors 330. Although the connector 330 may be the same on each of the ends 328, 329 of the shaft 302, other embodiments may use different connectors 300 at each end of the shaft 302. In FIG. 3, for instance, the connector 330 is the same on each end of the shaft 302, although rotated 90° relative to the opposing end. In other embodiments, the same connectors 330 may not be rotated relative to each other. In still other embodiments, the connectors 330 may be different on each end 328, 329 of the shaft 302.

Moreover, while FIGS. 3-5 illustrate the connectors 330 has including four, cassellating, wedge-shaped structures (i.e., two protrusions and two depressions), such structure is merely illustrative. In other embodiments, more or fewer than four structures may be included, and such structures may have different shapes or configurations. Further, each protrusion and/or depression may not have the same shape or size. In still other embodiments, a collar or other connector may be used to couple together two ends of adjacent turbine drives 300.

Figure 6:
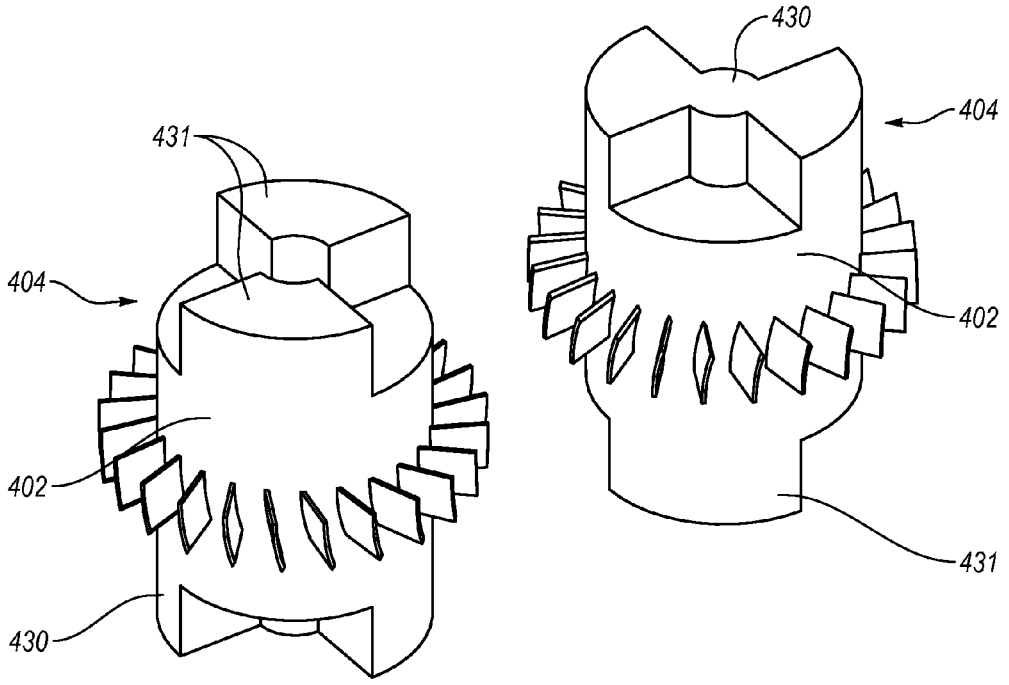
FIG. 6 illustrates a perspective view of two rotor shafts that may be used in corresponding turbine drive assemblies and coupled together in accordance with one embodiment of the present disclosure.
Figure 7:
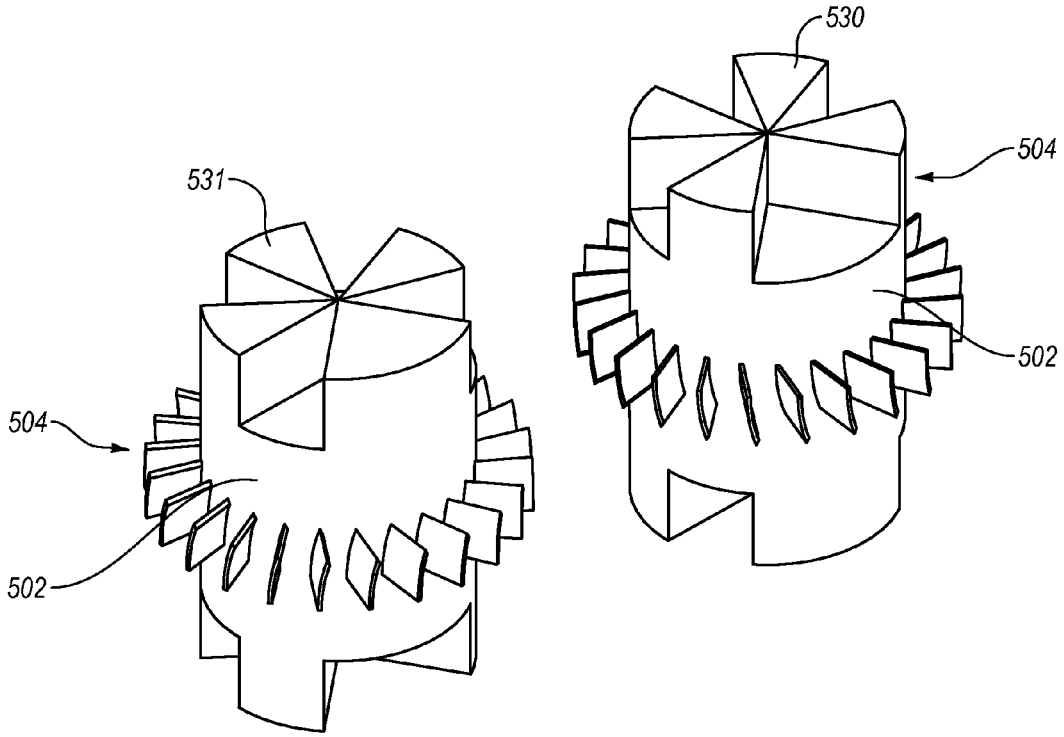
FIG. 7 illustrates a perspective view of two additional rotor shafts that may be used in corresponding turbine drive assemblies and coupled together in accordance with another embodiment of the present disclosure.

FIGS. 6 and 7 illustrate other example embodiments of connectors that may be used to allow modular turbine drives to be coupled together. In particular, FIG. 6 illustrates two rotors 404 that may be coupled together. For simplicity, the illustrated rotors 404 are not shown in an assembled form with corresponding stators, housing, or the like. In operation, however, the rotors 404 may be assembled with corresponding stators, housings, or other components for use in a motor.

In this particular embodiment, the two rotors 404 are shown with opposite ends oriented upwards. Thus, a shaft 402 of the rotor 404 may include corresponding connectors 430, 431 on opposing ends thereof. In this particular embodiment, the connector 430 is not identical to the connector 431 on the opposite end of the shaft 402. The connectors 430, 431 may, however, have complementary structures. Thus, if the connector 431 is aligned with the connector 430, the shafts 402 may drop in or otherwise be coupled together. As a result, when one shaft 402 rotates, the other shaft 402 may also rotate.

The illustrated embodiment shows the first connector 430 as including a bow tie-shaped protrusion with two corresponding rounded trapezoidal depressions. Such a connector may mate with the second connector 431 on the shaft 402 as the second connector 431 may have a generally opposite construction. In particular, FIG. 6 illustrates the second connector 431 as having rounded trapezoidal protrusions with a bow tie-shaped depression therebetween.

The precise shape and structure of the connectors 430, 431 may be changed or varied in different embodiments. Indeed, FIG. 7 illustrates another example embodiment that includes two rotors 504 having shafts 502 that may be coupled together using mating connectors 530, 531. In this particular embodiment, each connector 530, 531 has four wedge-shaped protrusions and four wedge-shaped depressions. Unlike the embodiment shown in FIGS. 3-5, however, the various wedge-shaped protrusions or depressions may not each be the same size. In particular, the connector 530 is shown as including four wedge-shaped protrusions of one size, although one of the four depressions may be larger than the other depressions and/or the protrusions. In a corresponding manner, the connector 531 may include one protrusion larger in size than the other wedge-shaped protrusions—which larger protrusion may correspond to the larger depression of the connector 530—while each of the four depressions of the connector 530 may be about the same size and/or shape.

In view of the embodiments illustrated in FIGS. 3-7, it should be appreciated that turbine drives and rotors may be coupled together in a number of different manners, and using structures of different types. In some embodiments, the connectors at opposing ends of a rotor shaft may be symmetrical, complementary, or identical, whereas in other embodiments the connectors may be different. Indeed, one feature of different connectors may be the ability to align turbine drives in a single direction. A feature of using identical connectors may be providing balance to a motor assembly.

Figure 10:
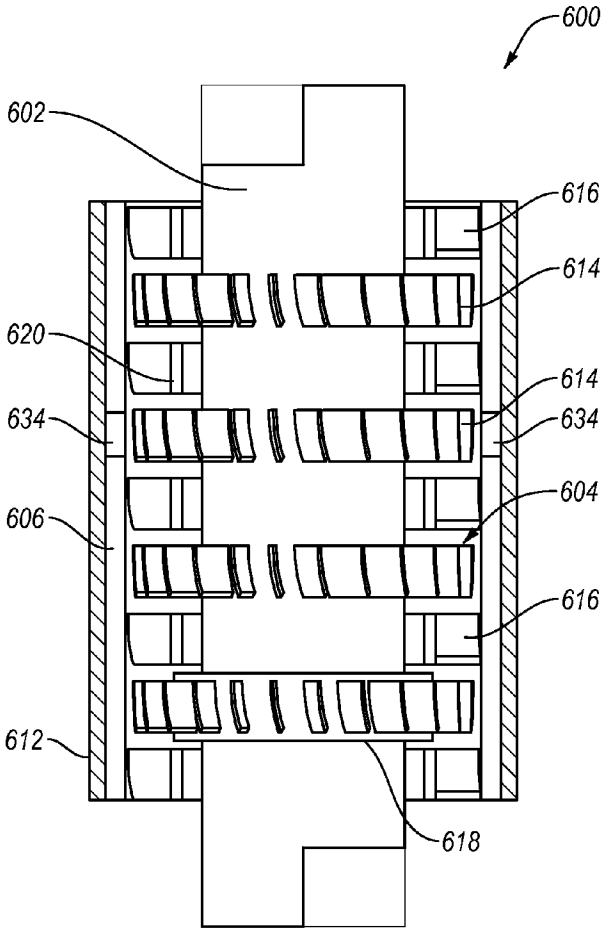
FIG. 10 illustrates a partial cross-sectional view of the turbine drive assembly of FIGS. 6 and 7 following assembly.

FIGS. 3-7 also illustrate example embodiments in which a rotor includes a single stage of turbine blades, although multiple rotors may be axially coupled together to provide a stack of rotor stages. In other embodiments, however, multiple stages of turbine blades may be combined into a single modular assembly. An example embodiment of the use of multiple rotor stages combined in a single modular assembly is illustrated in FIGS. 8-10.

Figure 8:
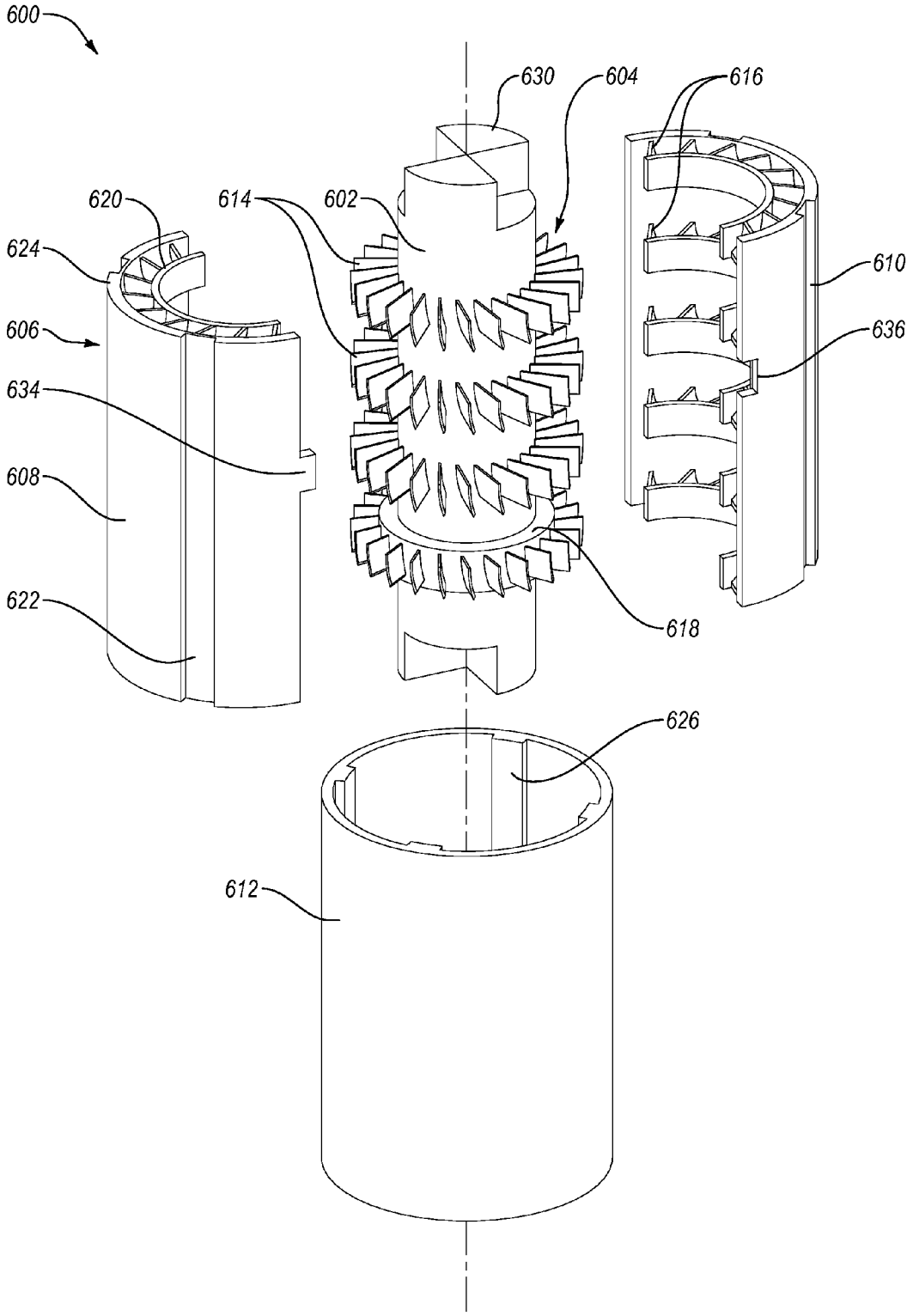
FIG. 8 illustrates an exploded, perspective view of a turbine drive assembly having multiple rotor stages, according to some embodiments of the present disclosure.
Figure 9:
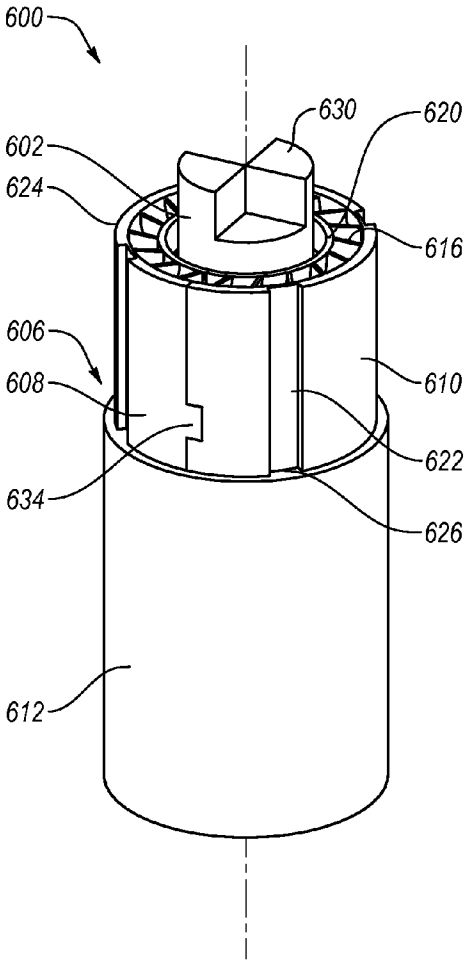
FIG. 9 illustrates a perspective view of the turbine drive assembly of FIG. 6 following partial assembly.

More particularly, FIG. 8 illustrates an exploded assembly view of a turbine drive 600 that includes a rotor 604 having multiple stages of turbine blades 614. In this particular embodiment, the rotor 604 includes four stages of turbine blades 614 stacked along an longitudinal axis of a shaft 602. Each of the four stages of turbine blades 614 is shown as being axially offset at about equal distances; however, such an embodiment is merely illustrative and there may be different distances between some stages of turbine blades 614.

As discussed herein, the turbine blades 614 may have any suitable construction, shape, and configuration. In the illustrated embodiment, the turbine blades 614 are shown as being inclined and having a curved profile shape. Further, in this particular embodiment, the turbine blades 614 are shown as extending from the outer surface of the shaft 602 in a cantilevered manner, such that the outer surfaces of the turbine blades 614 are unsupported. In other embodiments, however, an outer or inner ring or other support may be coupled to the various stages of turbine blades 614.

The turbine drive 600 may include a stator 606 for use in connection with the rotor 604. As shown in FIG. 8, the stator 606 may be formed from two stator components, which are illustrated in this embodiment as two stator halves 608, 610. When aligned axially, the two stator halves 608, 610 may be assembled together as illustrated in FIGS. 9 and 10, to collectively define the stator 606. In an assembled state, the stator 606 may substantially encompass the rotor 604 and/or multiple stages of turbine blades 614.

In another embodiment, however, the stator 606 and rotor 604 may be formed or manufactured in an assembled state. For instance, a three-dimensional printing process, an additive manufacturing process, or other system or process may be used. In such a system, the stator 606 may be formed as a unitary component, and potentially as a unitary assembly with the rotor 604. Consequently, FIGS. 9 and 10 may generally represent a combination of a rotor 604 and stator 606 in the manner formed during a manufacturing process, rather than following separate manufacturing and assembly processes.

The stator 606 may operate in a manner similar to that described herein for a single stage rotor, but may optionally include multiple or additional stages of vanes 616. As shown in FIGS. 8 and 9, for instance, the stator 606 may include an outer ring 624 and a corresponding inner ring 620. Sets or stages of circumferentially spaced vanes 616 may be positioned at different axial locations along the longitudinal length of the stator 606, and extend between the inner ring 620 and the outer ring 624. Thus, each of the stator halves 608, 610 may include portions of the vanes 616 for use with each turbine stage of the rotor 604, although in other embodiments, different configurations of stator components (e.g., separable, stacked stator rings) may be used in connection with the multiple turbine stages of the rotor 604. Any number of different stator components may also be used, and the stator 606 may be formed of more or less than two components, and such components may be aligned axially, offset axially, or have other structures or some combinations thereof.

Regardless of the particular structure of the stator 606, each set or stage, or some of the sets or stages, of the vanes 616 are optionally configured to redirect flow of a fluid, such as drilling fluid, for use with the turbine blades 614 of the rotor 604. For instance, in this particular embodiment, an upper stage of vanes 616 may redirect a fluid from an axial flow to a transverse flow that strikes against an uppermost stage of turbine blades 614. After contacting the turbine blades 614 of the uppermost stage, the fluid may flow into a second stage of vanes 616 within the stator 606, which redirect the flow to transversely contact the second stage of turbine blades 614. This process may be repeated with each successive stage of vanes 616 of the stator 606 and with each successive stage of turbine blades 614 of the rotor 604. A final, lowermost stage of vanes 616 following the final stage of turbine blades 614 may be omitted, or may be provided to redirect the fluid flow. For example, the final stage of vanes 616 may redirect the fluid to flow longitudinally and about parallel to the longitudinal axis of the turbine drive 600.

When the fluid flows against the turbine blades 614, the fluid may cause the rotor 604 to rotate. Each successive stage of turbine blades 614 may provide additional power or torque when rotating the rotor 604. In embodiments in which the rotor 604 is integral with, permanently coupled to, or compressed against, the shaft 602, the shaft 602 may also rotate. As discussed herein, the shaft 602 may rotate along with successive shafts of other turbine drives 600 and/or be coupled to a drive shaft of a BHA. When coupled to a drive shaft of a BHA, the rotating shaft 602 may supply power to rotate a bit, reamer, or other rotary tool of the BHA.

While the rotor 604 and shaft 602 may each rotate together, the stator 606 may be held relatively stationary (e.g., relatively stationary relative to a housing, body, or other component of the BHA). In one embodiment, the stator 606 may be held stationary using, at least in part, a housing 612. In the embodiment of FIGS. 8-10, the hosing 612 is illustrated as a sleeve that may extend around the outer ring 624 of the stator 606. In some embodiments, mechanical fasteners such as the tabs 626 on the interior surface of the housing 612 and the slots 622 on the exterior surface of the stator 606, or the corresponding tabs 624 on the interior surface of the housing 612 may be used to couple the stator 606 to the housing 612 and restrict, if not prevent, relative rotation therebetween. As discussed herein, other types of connectors, fasteners, or the like may be used.

The housing 612 may be or include a component configured primarily for use with a single turbine drive 600. Thus, as multiple turbine drives 606 are coupled together, each turbine drive 600 may have a separate housing 612. In other embodiments, however, a single housing 612 may be use with multiple turbine drives 600. As an example, the housing 612 may correspond to a body of a BHA. A single turbine drive 600, or multiple turbine drives 600, may be inserted into the housing 612 and multiple turbine drives 600 may be coupled together to provide power input for driving a rotary tool coupled to the BHA.

The turbine drive 600 may also include additional or other features. For instance, the turbine drive 600 may be constructed to restrict or prevent some axial movement of the rotor 604 relative to the stator 606. In such an embodiment, a collar 618 may be coupled to or even formed on the shaft 602. In FIG. 8 the collar 618 is shown as being positioned aligned with the lowermost set of turbine blades 614, although the collar 618 may be located at any other location, or multiple collars or other restriction elements may be provided. Moreover, in some embodiments, the collar 618 may be a bearing as discussed herein.

As shown in FIG. 10, if a collar 618 is included, the collar 618 may be positioned between two stages of vanes 616 of the stator 606. The separation between the stages of vanes 616 may be about equal to, or greater than, the height of the collar 618. As a result, there may be some axial movement, or potentially no axial movement, of the rotor 604 once within the stator 606. When some axial movement of the rotor 604 is allowed, the amount of movement may be minimal. For instance, the axial play or movement may be less than a depth of depressions within a connector 630 so that any movement does not dislodge the turbine drive 600 from an adjacent, connected turbine drive 600. In some embodiments, a rotor 604 can float within the stator 606 but the amount of play may be substantially less than the depth of the depressions of the connector 630. By way of example, the amount a rotor 604 may move axially within a stator 606 may be less than half, less than a quarter, or less than a tenth the depth of a depression of the connector 630, but in other embodiments may be larger or still smaller.

According to some embodiments of the present disclosure, the turbine drive 600 may include one or more features for facilitating assembly of the turbine drive 600. In the particular embodiment illustrated in FIGS. 8-10, the stator halves 608, 610 are shown as including circumferential tabs 634 and grooves 636. In particular, the illustrated first half 608 of the stator 606 may include a tab 634 at an edge thereof, which tab 634 can mate with a corresponding groove 636 at an edge of the second half 610 of the stator 606. Optionally, the tab 634 and groove 636 are not centered along the length of the stator halves 608, 610. As a result, if one of the stator halves 608, 610 is turned upside down, a tab 34 may be unable to be positioned in the corresponding groove 636. Of course, while FIG. 8 illustrates the slot 634 and the groove 636 on a single edge of the stator halves 608, 610, multiple alignment devices may be used on the same sides or opposite sides thereof. Indeed, the embodiment in FIG. 10 illustrates corresponding alignment features, which in this case are tabs 634, on both edges of a portion of the stator 606.

Other types of structures or mechanisms may also be used to facilitate alignment and/or assembly of the stator halves 608, 610 for use in the turbine drive 600. For instance, the stator 606 may not be symmetrical, or the distances between stacks of vanes 616 may be varied. Consequently, if one of the stator halves 608, 610 is upside down, it may be difficult or impossible to align the stator halves 608, 610 with the rotor 604. In other embodiments, pins, guides, threads, visual indicators, or other structures may be provided to facilitate alignment and assembly. Further, similar structures, guides, and tools may be provided to align the rotor 604 and the shaft 602 relative to the stator 606. In one example embodiment, the collar 618 may be sized or shaped to allow alignment between a specific two sets of vanes 616 within the stator 606. Thus, improper alignment of the rotor 604 or either stator half 608, 610 may make assembly difficult or impossible.

The various components of the turbine drive 600 may be manufactured in any number of difference sizes, and using a number of different materials or in a number of different manners. For instance, one embodiment of the present disclosure contemplates manufacturing the rotor 604 and/or stator 606 using a three-dimensional printing or other rapid prototyping process, or some other similar process. Such a process may be used whether the rotor 604 and/or stator 606 are formed separately, or as part of a unitary assembly upon manufacture. In using an example three-dimensional printing process, a three-dimensional printer may create the rotor 604 and/or stator 606 from a polymer, metal, alloy, or other material. Thereafter, such a component may be removed from the printer and assembled into the turbine drive 600. Where the component printed includes a unitary assembly of the rotor 604 and stator 606, the turbine drive 600 may be assembled by coupling to the housing 612. Where the rotor 604 and stator halves 608, 610 are formed separately, assembly may include assembling the stator halves 608, 610 around the rotor 604, and then coupling the housing 612 to the stator 606. In at least some embodiments, additional processing after the three-dimensional printing process may be used. For instance, a part produced from a polymer may undergo an electroplating process to deposit an additional metal, alloy, polymer, composite, or other material on the surfaces of the rotor 604 and/or stator 606. The selected material may provide abrasion or wear resistive properties, structural strength, corrosion resistance, lubricity, or any number of other properties. The material deposited may therefore also be varied depending on the properties to be provided. In other embodiments, a three-dimensional printing process that produces a metal or alloy part may also be electroplated or undergo additional processing.

Of course, other processes may also be used to produce the components of the turbine drive 600. For instance, molding, casting, or other similar processes may be used to produce the rotor 604, stator 606, and housing 612. As an example, an investment casting process can be used. Other molding or casting processes may also be used.

In still other embodiments, cutting, machining, extrusion, or other processes may be used for various components instead of, or in addition to, other manufacturing processes. As an example, an additive machining process may be used. In another example, the housing 612 may be extruded, or may be machined from a previously formed tube. Similarly, the rotor 604 and/or stator 606 may be machined from a solid material, or may be formed in another manner, and then machined to enhance or provide additional features. With respect to the stator 606, machining or cutting may be used to produce the two stator halves 608, 610. In particular, the stator 606 may be formed as a unitary component. Thereafter, the stator 606 may be cut into the corresponding stator halves 608, 610. In other embodiments, the stator halves 608, 610 may be formed separately so that no additional machining or cutting process is used. In still another alternative embodiment, as discussed herein, the stator 606 may be formed as a single component already positioned around the rotor 604.

In general, the turbine drive 600 may be produced, assembled or operate in a manner similar to the turbine drive 300 of FIGS. 3-5. Thus, features of the turbine drives 300 and 600 are intended to be interchangeable or combinable in any manner, unless a particular combination of features is described herein as being mutually incompatible. Moreover, embodiments of the present disclosure may therefore encompass methods for producing a turbine drive, a motor assembly, or some component thereof, using various manufacturing processes and techniques. Additional embodiments may encompass methods for using a turbine drive, motor assembly, or some component thereof, which is produced using any suitable manufacturing process or technique.

As with the turbine drive 300 of FIGS. 3-5, the turbine drive 600 may also be modular and used in connection with other turbine drives 600 as part of a motor assembly. The additional turbine drives 600 may each be the same, or they may vary in various regards (e.g., size, number of turbine stages, etc.). In combination, however, the stacked use of multiple turbine drives 600 may provide increased power relative to a single turbine drive 600. Thus, a motor assembly may be scalable based on the particular application in which it is used. Moreover, by including modular components, a component that fails or is damaged may be replaced in an efficient and cost effective manner as other components may not be affected.

Figure 11:
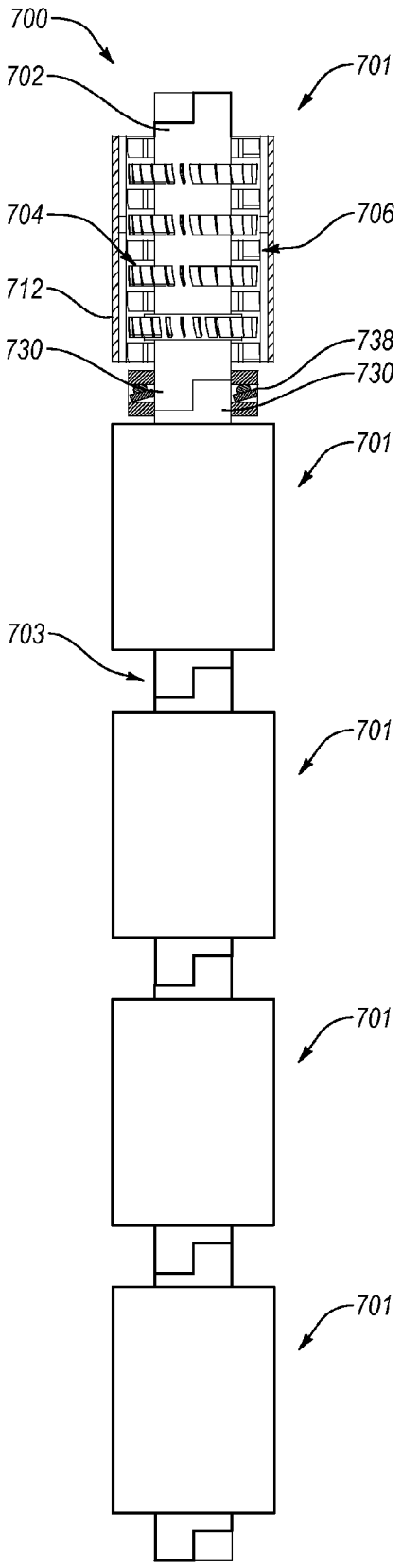
FIG. 11 illustrates a partial cross-sectional view of a motor assembly having multiple turbine drives, according to an embodiment of the present disclosure.

Turning now to FIG. 11, an example of a motor assembly 700 is illustrated, and includes multiple turbine drives 701. The illustrated turbine drives 701 may each be stacked or connected in series, and can be combined to provide differing amounts of power. Thus, for an application utilizing relatively low power, the illustrated five turbine drives 701 may be used. In an application using higher power, additional turbine drives 701 may be added.

In FIG. 11, the uppermost turbine drive 701 is shown in a partial cross-sectional view to illustrate an example of optional components. Each additional turbine drive 701 may include the same or similar components, or may be entirely different therefrom. Thus, while the uppermost turbine drive 701 includes a rotor 704 and stator 706 that support four turbine stages, the subsequent turbine drives 701 may also include four turbine stages, may include more or fewer than four turbine stages, or may include turbine stages of different sizes or configurations.

In the particular embodiment illustrated in FIG. 11, each turbine drive 701 may include a rotor 704 and a corresponding stator 706. The rotor 704 may be coupled to a shaft 702, and the rotor 704 and the shaft 702 optionally collectively rotate when fluid is directed into the turbine drive 701.

The stator 706 may fully or partially surround the rotor 704. In this embodiment, multiple stages of stator vanes are provided and may be used to redirect fluid entering the turbine drive 701. In particular, fluid may enter the stator 706 and be directed by the stator vanes towards the turbine blades. The stator vanes may transform generally laminar or axial flow into a transverse flow that increases the efficiency of the rotor 704 and/or directs the fluid to more directly strike the turbine blades.

Each shaft 702 is shown as including a connector 730 at the opposing ends thereof. The connectors 730 may allow each turbine drive 701 to be coupled together in an efficient manner. The particular structure of the connectors 730 may vary as discussed herein. In FIG. 11, however, the connectors 730 mate together to couple the shaft 702 and rotor 704 of one turbine drive 701 with the shaft 702 and rotor 704 of an axially adjacent turbine drive 701. The motor assembly 700 may thus include a segmented shaft 703 collectively defined as the combination of shafts 702 of each turbine drive 701, which segmented shaft 703 may be segmented and separable between each turbine drive 701. Moreover, when a turbine drive 701 transforms axial flow into rotational power that rotates the shaft 702, each shaft 702 (and thus the segmented shaft 703) may rotate synchronously or about synchronously.

In some embodiments, the shafts 702 may be coupled together using the connectors 730. In other embodiments, one or more other components may also be used. For instance, as shown in FIG. 11, one embodiment contemplates the use of a bearing 738 at or near where two shafts 702 interface. The bearing 738 is optional and may be provided between each turbine drive 701, between some turbine drives 701 and not others, or may be omitted entirely. If included, any suitable bearing 728 may be used, including a radial bearing or a thrust bearing.

Each turbine drive 701 of the motor assembly 700 of FIG. 11 may also include a housing 712 coupled to the corresponding stator 706. The housing 712 is optionally configured to be held stationary relative to the stator 706. For instance, as discussed herein, the stator 706 may be coupled to the housing 712 (e.g., through the use of longitudinal slots and tabs, pins, clamps, etc.) in a manner that resists or prevents rotation of the stator 706 relative to the housing 712. Such a coupling may be made without applying compressive forces to compress the housing 712 against the stator 706, or the stator 706 against the housing 712; however, other embodiments may utilize compression.

Figure 12:
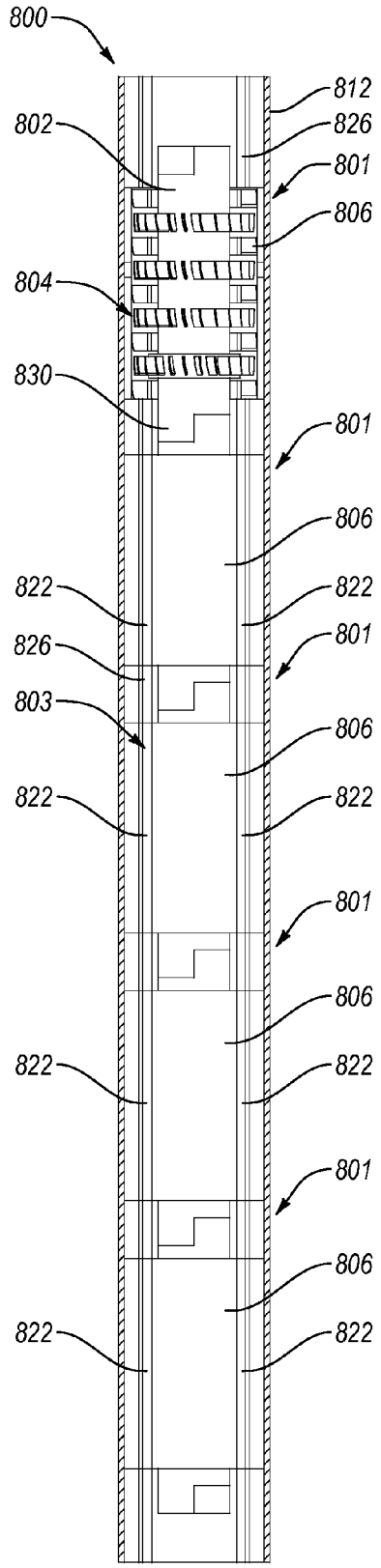
FIG. 12 illustrates a partial cross-sectional view of a motor assembly having multiple turbine drives within a single housing, according to an embodiment of the present disclosure.

In some embodiments, a separate housing 712 may be used for each turbine drive. In other embodiments, however, a single housing may be used in connection with multiple turbine drives. For instance, turning now to FIG. 12, an example motor assembly 800 is illustrated and includes multiple turbine drives 801 coupled in sequence using a series of connectors 830 of connectable shafts 802 to form a segmented shaft 803. Each turbine drive 801 may include a rotor 804 cooperating with a corresponding stator 806. The rotor 804 is optionally integrally formed with the shaft 802, or otherwise coupled thereto for synchronous rotation with the shaft 802. In this embodiment, the same housing 812 is coupled to each of five turbine drives 801, although such an embodiment is merely illustrative and a single housing 812 could couple to a single turbine drive 801, to less than five turbine drives 801, or to more than five turbine drives 812.

While the rotors 804 may rotate with the shafts 802 (and the segmented shaft 803), the stators 806 may have a different rotation or may have no rotation. In one embodiment, the stators 806 may be coupled to a housing 812 in a manner that resists or prevents some rotational movement of the stators 806, or which locks rotation of the stators 806 to be synchronous with that of the housing 812. In the illustrated embodiment, the same housing 812 is coupled to each of the multiple turbine drives 801. In particular, the housing 812 may have a generally tubular structure that forms a sleeve into which the various turbine drives 801 can be inserted or otherwise positioned. In this particular embodiment, the housing 812 is shown in a cross-sectional view, with various tabs 826 shown as extending longitudinally along the interior surface thereof. The tabs 826 may mate with corresponding slots 822 on the exterior surfaces of the stators 806. In particular, in FIG. 12, the slots 822 may be formed as longitudinal grooves that have a size and shape corresponding to that of the tabs 826 to allow the tabs 826 to be inserted therein. When in place, the tabs 826 may effectively lock the housing 812 to the stator 806 so that any rotation of the stator 806 is synchronous with the rotation of the housing 812.

As should be appreciated by a person having ordinary skill in the art in view of the disclosure herein, the motor assemblies and turbine drives used herein may be used in a variety of different environments. For instance, the motor assembly 800 may be used in connection with a BHA used for drilling subterranean earthen formations, milling a casing, milling a plug, cutting drilling through downhole tools, or for other downhole operations. In such an embodiment, the BHA may include the motor assembly 800 along with any number of turbine drives 801 to power a rotary tool such as a bit. As drilling fluid is pumped into the BHA, the fluid may power the various turbine drives 801, thereby causing the rotors 804 and the shafts 802 to rotate. The shafts 802 may collectively be coupled to, or define, a drive shaft rotating the bit or other rotary tool, and can provide power thereto. While the turbine drives 801 may also be coupled to magnetic components (not shown) that use the rotation within the turbine drives 801 to produce an electrical current that then drives the rotary tool, other embodiments may drive the rotary tool directly without the use of magnetic or electrical components. Thus, hydraulic and mechanical energy alone may be used in some embodiments for rotating a rotary tool of a BHA.

In the context of a BHA, the motor assembly 800 may be coupled to the BHA in any suitable manner. For instance, the housing 812 may be inserted into a body of the BHA and secured in place. In other embodiments, the housing 812 may be formed as part of the body of the BHA. Accordingly, a BHA may have a body structured specifically for use with corresponding turbine drives 801 of any suitable type. In some embodiments, the body of the BHA may include the tabs 826 or other structures that couple the body to the stators 806 of the turbine drives 801. In such an embodiment, the tabs 826 or other structures may extend along the full length of the body, or they may be limited in length but coincide to a portion of the body associated with the location of the motor assembly 800.

The size of the various components may also be varied or changed depending on the application. In some embodiments, for instance, a relatively small wellbore may be desired. As an example, a wellbore may have a size of less than about 8 inches (203 mm), less than about 5 inches (127 mm), less than about 3 inches (76 mm), or less than about 2 inches (51 mm). As an example, the diameter of the turbine drive may be about 2⅛ inches (54 mm), although such an example is merely illustrative. In other embodiments, a wellbore or components of the turbine drive may be less than about 2 inches (51 mm) or greater than about 8 inches (203 mm).

The operating conditions within a BHA, and within the motor assembly 800, may also vary. For instance, in one embodiment, a pump or other component may provide hydraulic fluid (e.g., drilling mud or another drilling fluid) to the turbine drives at a pressure between about 1,000 psi (6,895 kPa) and 2,000 psi (13,790 kPa) and/or a flow rate of between about 60 gpm (3.8 L/s) and 100 gpm (6.3 L/s). Using the turbine drives 801, such volumetric flow may be used to produce a rotation at a bit or other rotary tool of between 5,000 and 10,000 rpm. Such rotation may be geared down or up from the rotation of the shafts 801 if a gear box (not shown) is provided in the BHA.

In some embodiments, the motor assembly 800 may be used in connection with a so-called "turbodrill", although other tools may also include the motor assembly 800, a turbine drive 801, or other components as discussed herein. According to at least some embodiments, a turbodrill or other rotary tool may be used in a wellbore in connection with a coiled tubing drill string, although such components may also be used with segmented drill pipe or other types of work strings.

While motor assemblies (e.g., 700 and 800) and turbine drives (e.g., 701 and 801) are described herein with primary reference to downhole tools and drilling rigs, such embodiments are provided solely to illustrate one environment in which aspects of the present disclosure may be used. In other embodiments, motor assemblies, turbine drives, or other components discussed herein, or which would be appreciated in view of the disclosure herein, may be used in other applications, including in automotive, aquatic, aerospace, hydroelectric, or other industries.

In the description herein, various relational terms are provided to facilitate an understanding of various aspects of some embodiments of the present disclosure. Relational terms such as "bottom," "below," "top," "above," "back," "front," "left", "right", "rear", "forward", "up", "down", "horizontal", "vertical", "clockwise", "counterclockwise," "upper", "lower", and the like, may be used to describe various components, including their operation and/or illustrated position relative to one or more other components. Relational terms do not indicate a particular orientation for each embodiment within the scope of the description or claims. For example, a component of a BHA that is "below" another component may be more downhole while within a vertical wellbore, but may have a different orientation during assembly, when removed from the wellbore, or in a deviated borehole. Accordingly, relational descriptions are intended solely for convenience in facilitating reference to various components, but such relational aspects may be reversed, flipped, rotated, moved in space, placed in a diagonal orientation or position, placed horizontally or vertically, or similarly modified. Relational terms may also be used to differentiate between similar components; however, descriptions may also refer to certain components or elements using designations such as "first," "second," "third," and the like. Such language is also provided merely for differentiation purposes, and is not intended limit a component to a singular designation. As such, a component referenced in the specification as the "first" component may for some but not all embodiments be the same component that referenced in the claims as a "first" component.

Furthermore, to the extent the description or claims refer to "an additional" or "other" element, feature, aspect, component, or the like, it does not preclude there being a single element, or more than one, of the additional element. Where the claims or description refer to "a" or "an" element, such reference is not be construed that there is just one of that element, but is instead to be inclusive of other components and understood as "one or more" of the element. It is to be understood that where the specification states that a component, feature, structure, function, or characteristic "may," "might," "can," or "could" be included, that particular component, feature, structure, or characteristic is provided in some embodiments, but is optional for other embodiments of the present disclosure. The terms "couple," "coupled," "connect," "connection," "connected," "in connection with," and "connecting" refer to "in direct connection with," "integral with," or "in connection with via one or more intermediate elements or members."

Although various example embodiments have been described in detail herein, those skilled in the art will readily appreciate in view of the present disclosure that many modifications are possible in the example embodiment without materially departing from the present disclosure. Accordingly, any such modifications are intended to be included in the scope of this disclosure. Likewise, while the disclosure herein contains many specifics, these specifics should not be construed as limiting the scope of the disclosure or of any of the appended claims, but merely as providing information pertinent to one or more specific embodiments that may fall within the scope of the disclosure and the appended claims. Any described features from the various embodiments disclosed may be employed in combination. In addition, other embodiments of the present disclosure may also be devised which lie within the scopes of the disclosure and the appended claims. Each addition, deletion, and modification to the embodiments that falls within the meaning and scope of the claims is to be embraced by the claims.

In the claims, means-plus-function clauses are intended to cover the structures described herein as performing the recited function, including both structural equivalents and equivalent structures. Thus, although a nail and a screw may not be structural equivalents in that a nail employs a cylindrical surface to couple wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words 'means for' together with an associated function.

Certain embodiments and features may have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. Certain lower limits, upper limits and ranges may appear in one or more claims below. Any numerical value is "about" or "approximately" the indicated value, and take into account experimental error and variations that would be expected by a person having ordinary skill in the art.

What is claimed is:

1. A downhole tool for converting hydraulic flow into rotational power in a wellbore, comprising:

a downhole motor housing;

a turbine drive within the downhole motor housing, comprising:

a shaft;

a rotor having at least one set of turbine blades coupled to the shaft, each set of turbine blades having a plurality of circumferentially offset and axially aligned blades; and a stator having an outer ring, at least two sets of interior rings, and at least two sets of vanes cooperating with the at least one set of turbine blades, each set of vanes having a plurality of circumferentially offset and axially aligned vanes coupled to one of the at least two sets of interior rings, both of the at least two sets of vanes directly connected to the outer ring, and each set of vanes of the at least two sets of vanes being axially offset from each other set of vanes of the at least two sets of vanes, the stator further including separable first and second components each having a portion of the outer ring, a portion of each of the at least two sets of interior rings, and a portion of each of the at least two sets of vanes, the stator having more sets of vanes than the rotor has sets of turbine blades; and a drive shaft coupled to the shaft of the turbine drive and configured to couple to a drill bit.

2. The downhole tool recited in claim 1, the shaft being integrally formed with the at least one set of turbine blades.

3. The downhole tool recited in claim 1, the at least one set of turbine blades including at least two axially offset sets of turbine blades coupled to the shaft.

4. The downhole tool recited in claim 3, the first and second components of the stator collectively defining at least three axially offset sets of vanes for directing fluid against the at least two sets of turbine blades of the rotor.

5. The downhole tool recited in claim 1, further comprising: a shaft connector at each end of the shaft.

6. The downhole tool recited in claim 1, the turbine blades being circumferentially positioned around the shaft, the turbine blades and the shaft being configured to rotate together in an absence of a compression element for maintaining a rotation of the shaft constant with a rotation of the rotor.

7. The downhole tool recited in claim 1, wherein the downhole motor housing configured to enclose the first and second components of the stator.

8. The downhole tool recited in claim 7, further comprising:

mating structures on the downhole motor housing and the first and second components of the stator, the mating structures configured to restrict rotation of the first and second components of the stator relative to the downhole motor housing.

9. The downhole tool recited in claim 8, the mating structures including longitudinal tabs and slots.

10. The downhole tool recited in claim 1, the shaft and plurality of turbine blades being integrally formed through a rapid prototyping, additive machining, or investment casting manufacturing process.

11. A downhole tool comprising:

a body;

a motor assembly coupled to the body, the motor assembly including a plurality of turbine drives each having a stator and a rotor coupled to a rotatable shaft, the rotor of each turbine drive being configured to rotate synchronously with the rotatable shaft, in the absence of compression, the rotor having at least one set of turbine blades coupled to the shaft, each set of turbine blades having a plurality of circumferentially offset and axially aligned blades, the stator having an outer ring, at least two sets of interior rings, and at least two sets of vanes cooperating with the at least one set of turbine blades, each set of vanes having a plurality of circumferentially offset and axially aligned vanes coupled to one of the at least two sets of interior rings, both of the at least two sets of vanes directly connected to the outer ring, and each set of vanes of the at least two sets of vanes being axially offset from each other set of vanes of the at least two sets of vanes, the stator further including separable first and second components each having a portion of the outer ring, a portion of each of the at least two sets of interior rings, and a portion of each of the at least two sets of vanes, the stator having more sets of vanes than the rotor has sets of turbine blades, the rotatable shafts of adjacent turbine drives of the plurality of turbine drives connecting end-to-end and the rotatable shafts of the plurality of turbine drives collectively defining a segmented shaft of the motor assembly;

a drive shaft coupled to the segmented shaft of the motor assembly; and a rotary tool coupled to the drive shaft.

12. The downhole tool recited in claim 11, further comprising:

a housing coupled to the stator in a manner that resists rotation relative to each other.

13. The downhole tool recited in claim 11, the body defining a housing coupled directly to the stator of each of the plurality of turbine drives of the motor assembly.

14. A method for rotating a downhole tool, comprising:

inserting a downhole tool into a wellbore, the downhole tool including a bit and a motor for rotating the bit, the motor including one or more turbine drives, each of the one or more turbine drives including:

a shaft;

a rotor having a plurality of axially offset sets of turbine blades coupled to the shafts a first set of turbine blades of the plurality of axially offset sets of turbine blades including a collar having a height greater than a height of the turbine blades of the first set of turbine blades; and a stator having an outer ring, at least two sets of interior rings, and a plurality of axially offset sets of vanes coupled to one of the at least two sets of interior rings for directing fluid against the plurality of axially offset sets of turbine blades, the plurality of axially offset sets of vanes directly connected to the outer ring, the stator further including separable first and second components each having a portion of the outer ring, a portion of each of the at least two sets of interior rings, and a portion of each of the at least two sets of vanes, the stator having more sets of vanes than the rotor has sets of turbine blades; and powering the downhole tool while within the wellbore, wherein powering the downhole tool includes flowing drilling fluid through a drill string to the downhole tool, where the drilling fluid strikes against the plurality of axially offset sets of turbine blades to rotate the shaft and rotor independent of the stator, the shaft being coupled to the bit.

15. The method recited in claim 14, the rotor being permanently coupled to the shaft for rotation with the shaft.

16. The method recited in claim 14, the one or more turbine drives further including a housing coupled to an exterior surface of the stator and restricting relative rotation therebetween.

17. The method recited in claim 14, the stator being separable into multiple components which, when combined, enclose the plurality of axially offset sets of turbine blades.

18. The method recited in claim 14, the stator and the rotor being collectively manufactured in a unitary manufacturing process and in an already assembled state, using:

a rapid prototyping process, a three-dimensional printing process, an additive manufacturing process, or an investment casting manufacturing process.

* * * * *